US011223103B2

(12) United States Patent
Gu

(10) Patent No.: US 11,223,103 B2
(45) Date of Patent: Jan. 11, 2022

(54) ANTENNA DEVICE AND MIMO ANTENNA ARRAYS FOR ELECTRONIC DEVICE

(71) Applicant: Huanhuan Gu, Waterloo (CA)

(72) Inventor: Huanhuan Gu, Waterloo (CA)

(73) Assignee: Huawei Technologies Co., Ltd., Shenzhen (CN)

( * ) Notice: Subject to any disclaimer, the term of this patent is extended or adjusted under 35 U.S.C. 154(b) by 574 days.

(21) Appl. No.: 15/881,343

(22) Filed: Jan. 26, 2018

(65) Prior Publication Data

US 2019/0237851 A1 Aug. 1, 2019

(51) Int. Cl.

| | |
|---|---|
| ***H01Q 9/04*** | (2006.01) |
| ***H01Q 1/24*** | (2006.01) |
| ***H01Q 5/10*** | (2015.01) |
| ***H01Q 5/35*** | (2015.01) |

(52) U.S. Cl.

CPC ..... *H01Q 1/243* (2013.01); *H01Q 5/10* (2015.01); *H01Q 5/35* (2015.01); *H01Q 9/0435* (2013.01)

(58) Field of Classification Search

CPC ..... H01Q 1/243; H01Q 5/10; H01Q 5/35; H01Q 9/0435; H01Q 21/28

See application file for complete search history.

(56) References Cited

U.S. PATENT DOCUMENTS 7,671,804 B2 * 3/2010 Zhang ..... H01Q 5/371 343/700 MS
2012/0299785 A1 * 11/2012 Bevelacqua ..... H01Q 5/328 343/702
2013/0099996 A1 * 4/2013 Tseng ..... H01Q 9/42 343/876
2013/0300618 A1 * 11/2013 Yarga ..... H01Q 1/38 343/720
2015/0188225 A1 * 7/2015 Chang ..... H01Q 1/243 343/702
2017/0047950 A1 * 2/2017 Chen ..... H01Q 1/243

(Continued)

FOREIGN PATENT DOCUMENTS

CN 103066375 A 4/2013
CN 205104610 U 3/2016

(Continued)

OTHER PUBLICATIONS

Dongtak Kim et al., "MIMO Antenna with Decoupling Network for Headset Applications", 2013 Asia-Pacific Microwave Conference Proceedings, pp. 46-48.

(Continued)

*Primary Examiner* — David E Lotter

(57) ABSTRACT

Radio Frequency (RF) signal antenna devices and MIMO antenna portion arrays including the RF signal antenna devices are described. An antenna device includes a radiator that functions both as a first antenna and as a second antenna, a ground terminal directly connected to the radiator between a first end and a second end of the radiator, a first feed terminal for the first antenna, directly connected to the radiator at a first feed point between the first end of the radiator and the ground terminal; and a second feed terminal for the second antenna, directly connected to the radiator at a second feed point between the second end of the radiator and the ground terminal.

18 Claims, 12 Drawing Sheets

(56) References Cited

U.S. PATENT DOCUMENTS

2018/0309189 A1* 10/2018 Gu ..... H01Q 1/243

FOREIGN PATENT DOCUMENTS

| | | | |
|---|---|---|---|
| CN | 106450771 | A | 2/2017 |
| TW | 201530914 | A | 8/2015 |

OTHER PUBLICATIONS

Yong-Ling Ban et al., "4G/5G Multiple Antennas for Future Multi-Mode Smartphone Applications", IEEE Access, vol. 4, 2016, pp. 2981-2988.

Huanhuan Gu et al., "Broadband MIMO Antenna System for Electronic Device", U.S. Appl. No. 15/494,048, filed Apr. 21, 2017.

* cited by examiner

ANTENNA DEVICE AND MIMO ANTENNA ARRAYS FOR ELECTRONIC DEVICE

FIELD

The present disclosure relates to antennas, and in particular, to a radio frequency (RF) antenna device and arrangements of antenna arrays including the RF antenna device in an electronic device.

BACKGROUND

Ever more functionality and technology are being integrated into modern electronic devices, such as smart phones. Sometimes, additional hardware may need to be added to the electronic device in order to provide new functionality. New broadband technologies will require technology compatible antennas to be included in electronic devices. These additional antennas will often need to co-exist with one or more other antennas that support other radio access technologies, including for example antennas that support: fifth generation (5G) wireless communications technologies; fourth generation (4G) wireless communications technologies including 4G main and diversity antennas for one or more of Low-band (LB), mid-band (MB), and high-band (HB); Wi-Fi (2.4 GHz and 5 GHz); Bluetooth (2.4 GHz); and GPS (1.5 GHz).

In a conventional mobile or wireless electronic device, antennas may be printed on a Printed Circuit Board (PCB) of the device, supported within the device housing on antenna support carriers, or integrated into the device housing. There is, however, limited available physical space in the electronic device. Additional antennas can take up space that could be used by other hardware on the PCB. Furthermore, layout of an existing PCB design may need to be changed or rearranged in order accommodate additional antennas on the ground plane of the PCB.

It is desirable to have an antenna that supports broadband radio access technologies, is space efficient and is convenient to implement in an electronic device.

SUMMARY

The present description describes example embodiments of antenna devices and arrangements of antenna arrays that include the antenna devices. In example embodiments, the antenna device includes radiator that functions simultaneously as two antennas, enabling a more compact size than the use of two separate radiators. The antenna device, or antenna arrays including the antenna device, may be implemented in an electronic device without occupying excessive space on the device PCB or in the housing of the electronic device, and without requiring extensive changes to the layout of an existing PCB design.

An antenna device is disclosed according to a first aspect. The antenna device includes a radiator that functions both as a first antenna and as a second antenna, a ground terminal directly connected to the radiator between a first end and a second end of the radiator, a first feed terminal for the first antenna, directly connected to the radiator at a first feed point between the first end of the radiator and the ground terminal; and a second feed terminal for the second antenna, directly connected to the radiator at a second feed point between the second end of the radiator and the ground terminal.

In some example embodiments of the first aspect, dimensions of the radiator and locations of the ground terminal, first feed terminal and second feed terminal configure the first antenna to radiate signals within a first target frequency band and the second antenna to radiate signals within a second target frequency band that is different than the first target frequency band. In some examples, the ground terminal is located closer to the first end of the radiator than the second end of the radiator.

In some examples, the radiator is an oblong, planar conductive element. In some examples, the radiator is rectangular or approximately rectangular.

In some examples of the first aspect, the first antenna and second antennas are each quarter wavelength antennas. In some examples, a distance of the first feed point from the first end of the radiator is less than ¼ of a wavelength ($\lambda 1$) of a radio wave signal within a first target frequency band, and a distance of the second feed point from the second end of the radiator is less than ¼ of a wavelength ($\lambda 2$) of the a radio wave signal within a second target frequency band.

In some examples, $\lambda 1 = \lambda 2$, and in some examples $\lambda 1 \neq \lambda 2$. In some examples, the radiator has a length of L=35 mm+/−15%, the distance of the first feed point from the first end of the radiator is 14 mm+/−15%, and the distance of the second feed point from the second end of the radiator is 14 mm+/−15%. In some examples, the ground terminal is located at a mid-point between the first feed point and the second feed point.

In some examples of the first aspect, dimensions of the radiator and locations of the ground terminal, first feed terminal and second feed terminal configure the first antenna and the second antenna to radiate signals within a target frequency band of between 3 GHz and 6 GHz. In some examples, the target frequency band is either a 3.5 GHz band or a 5 GHz band.

In some examples, the dimensions of the radiator and locations of the ground terminal, first feed terminal and second feed terminal configure the first antenna to radiate signals within a 3.5 GHz band, and the second antenna to radiate signals within a 5 GHz band.

In some examples, the antenna device includes a third antenna portion having a first end connected to the radiator in electrical communication with the ground terminal, and a third feed terminal connected with the third antenna portion and spaced apart from the first end of the third antenna portion. In some examples, the third antenna portion includes a bend along the length between a distal end of the third antenna portion and the third feed terminal.

According to a second aspect is an electronic device that includes a housing enclosing a radio frequency (RF) communications circuit, and a multiple input multiple output (MIMO) antenna array electrically connected to the RF communications circuit, the MIMO antenna array including an antenna device. In an example embodiment, the antenna device includes a radiator that functions both as a first antenna and as a second antenna, a ground terminal directly connected to the radiator between a first end and a second end of the radiator, a first feed terminal for the first antenna, directly connected to the radiator at a first feed point between the first end of the radiator and the ground terminal, and a second feed terminal for the second antenna, directly connected to the radiator at a second feed point between the second end of the radiator and the ground terminal.

In some examples of the second aspect, dimensions of the radiator and locations of the ground terminal, first feed terminal and second feed terminal configure the first antenna to radiate signals within a first target frequency band and the second antenna to radiate signals within a second target frequency band. In some examples the first target frequency band and the second target frequency band are the same, and in some examples, the first target frequency band and the second target frequency band are different. In some examples the housing comprises a back enclosure element surrounded by forwardly projecting rim, wherein the radiator is located in the rim. In some examples, the rim is formed from metal, the radiator being insert molded into the rim and having an outer surface forming part of an outer surface of the rim. In some examples, the rim is formed from plastic, the radiator being formed on the rim using a laser direct structuring (LDS) process. In some examples, the rim is formed from plastic, the radiator being integrated into a flex printed circuit board (PCB) secured to the rim.

In some examples, a rim of the housing includes a top rim portion and a bottom rim portion that extends between first and second side rim portions at a top and bottom of the housing respectively, wherein the radiator is located in one of the first and second side rim portions, the electronic device further including at least one further antenna located in one of the top rim portion and the bottom rim portion, the at least one further antenna having a different resonant frequency than resonant frequencies of the first and second antennas.

BRIEF DESCRIPTION OF THE DRAWINGS

Reference will now be made, by way of example, to the accompanying drawings which show example embodiments of the present disclosure, and in which.

Similar reference numerals may have been used in different figures to denote similar components.

DESCRIPTION OF EXAMPLE EMBODIMENTS

Figure 1:
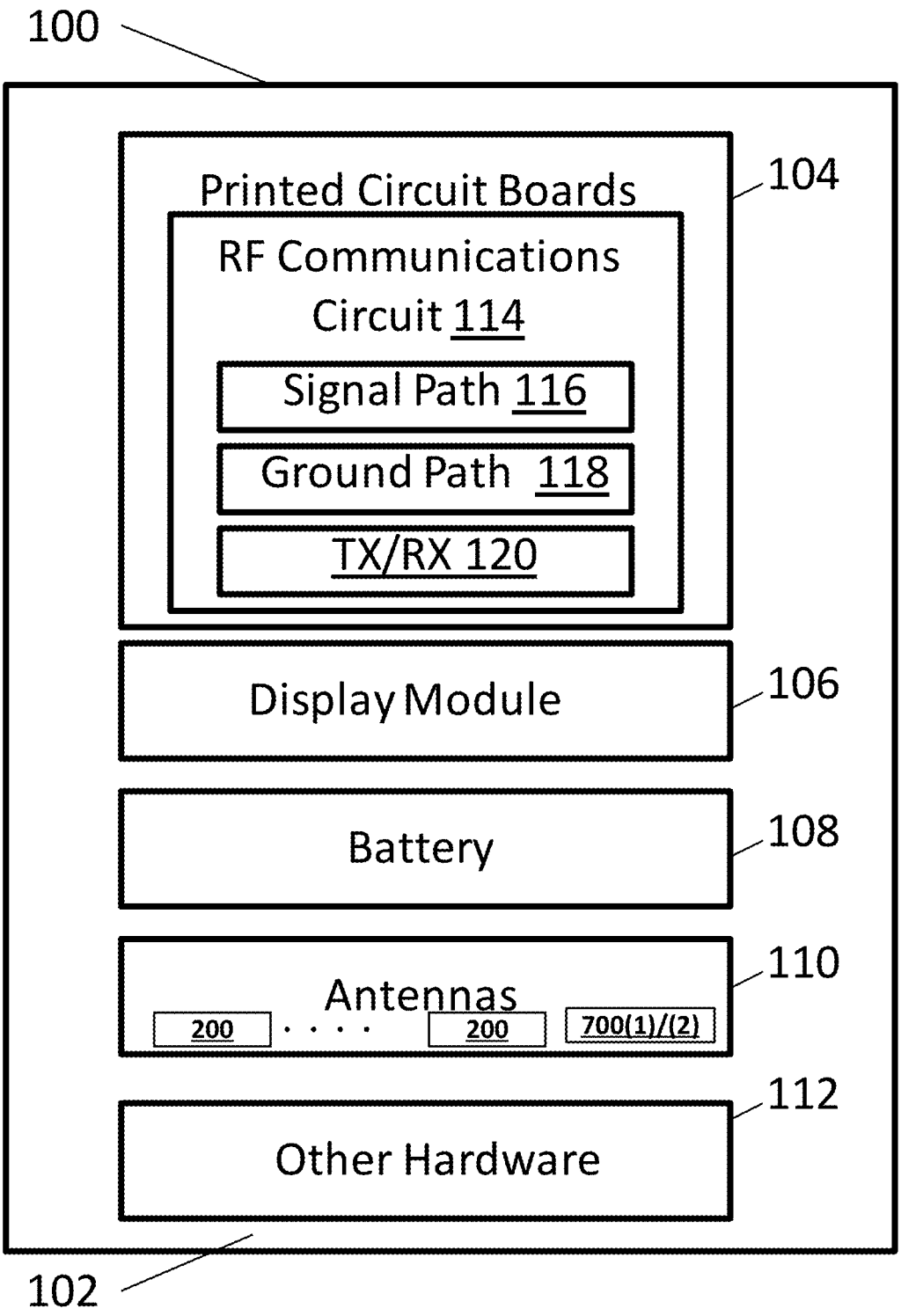
FIG. 1 is a block diagram that illustrates an example of an electronic device according to example embodiments.

FIG. 1 illustrates an example of an electronic device 100 according to the present disclosure. The electronic device 100 may be a mobile device that is enabled to receive and/or transmit radio frequency (RF) signals including for example, a tablet, a smart phone, a Personal Digital Assistant (PDA), a mobile station (STA) or an Internet of Things (IOT) device, among other things. The electronic device 100 includes a housing 102 for supporting, housing and enclosing hardware of the electronic device 100. Hardware of the electronic device may include at least one Printed Circuit Board (PCB) 104, a display module 106, a battery 108, one or more antenna systems 110 including an array of antenna devices 200(1) to 200(4) (referred to generically as antenna devices 200), and other hardware 112 including various circuits formed by electronic components including sensors, speakers, or cameras, for example.

As will be described in greater detail below, each antenna device 200 includes a radiator 202 that functions as two antennas 200*a* and 200*b*. Newer radio access technologies (RATs), for example 5G wireless technologies, are expected to require faster data rates and higher data throughput in the air interface. A multiple-input and multiple-output (MIMO) antenna array may be used to increase the capacity of wireless channels without extra radiation power or spectrum bandwidth. In a multipath wireless environment, the capacity of wireless channels generally increases in proportion to the number of transmitting and receiving antennas of a MIMO antenna array. Therefore, if antenna device 200 includes two antennas, a set of four antenna devices 200 can function as an 8×8 MIMO antenna array.

In an example embodiment, PCB 104 includes a plurality of layers including at least one signal layer and at least one ground layer. The signal layer includes a plurality of conductive traces that form signal paths 116 through the PCB layer. The ground layer of the PCB 104 forms a common ground reference in the PCB 104 for current returns of the electronic components and shielding, and includes a plurality of conductive traces that form ground paths 118. Conductive vias are formed through the PCB 104 to extend the signal paths 116 and ground paths 118 to surface connection points (such as pads for terminals of electronic components) on the PCB 104. Electronic components are populated on the PCB 104 to form circuits capable of performing desired functions. Electronic components may include, for example, integrated circuit (IC) chips, capacitors, resistors, inductors, diodes, transistors and other components.

In example embodiments, an RF communications circuit 114 is implemented by PCB 104 and the components populated on PCB 104. For example, RF communications circuit 114 may include one or more signal paths 116 and ground paths 118, an RF transceiver circuit 120, electrical connectors for connecting to antenna devices 110, and other circuitry required for handling RF wireless signals. In example embodiments, RF transceiver circuit 120 can be formed from one or more integrated circuits and include modulating circuitry, power amplifier circuitry, low-noise input amplifiers and other components required to transmit or receive RF signals.

In an example, transceiver circuit (TX/RX) 120 includes components to implement transmitter circuitry that modulates baseband signals to a carrier frequency and amplifies the resulting modulated electric current signals. The amplified electric current signals are then sent from the transceiver circuit 120 using signal paths 116 to the antenna device 200. Antennas (for example antennas 200*a*, 200*b*) formed by the antenna device 200 then convert the electric current signals to radio wave signals that are radiated into a wireless transmission medium. In an example, antennas formed by the antenna device 200 receive external radio wave signals for the transceiver circuit 120 to process. The external radio wave signals, for example, may be RF signals originating from a transmit point or a base station. The transceiver circuit 120 includes components to implement receiver circuitry that receives electric current signals that correspond to the radio wave signals through signal paths 116 from the antenna systems 110. The transceiver circuit 120 may include a low noise amplifier (LNA) for amplifying the received signals and a demodulator for demodulating the received signals to baseband signals. In some examples, RF transceiver circuit 120 may be replaced with a transmit-only circuitry and in some examples, RF transceiver circuit 120 may be replaced with a receiver-only circuitry.

As will be explained in greater detail below, the housing 102 includes a back enclosure element with a rim or side that extends around a perimeter of the back enclosure element. A front enclosure element (not shown), which may for example include a touch-screen, will typically be located on the front of the housing 102. In an embodiment, the rim, the front enclosure element and the back enclosure element together securely enclose hardware of the electronic device 100 including PCB 104 and the components populated on PCB 104. In an embodiment, the housing 102 may be formed from one or more materials such as metal, plastic, carbon-fiber materials or other composites, glass, ceramics, or other suitable materials.

Antenna Device 200

Figure 2A:
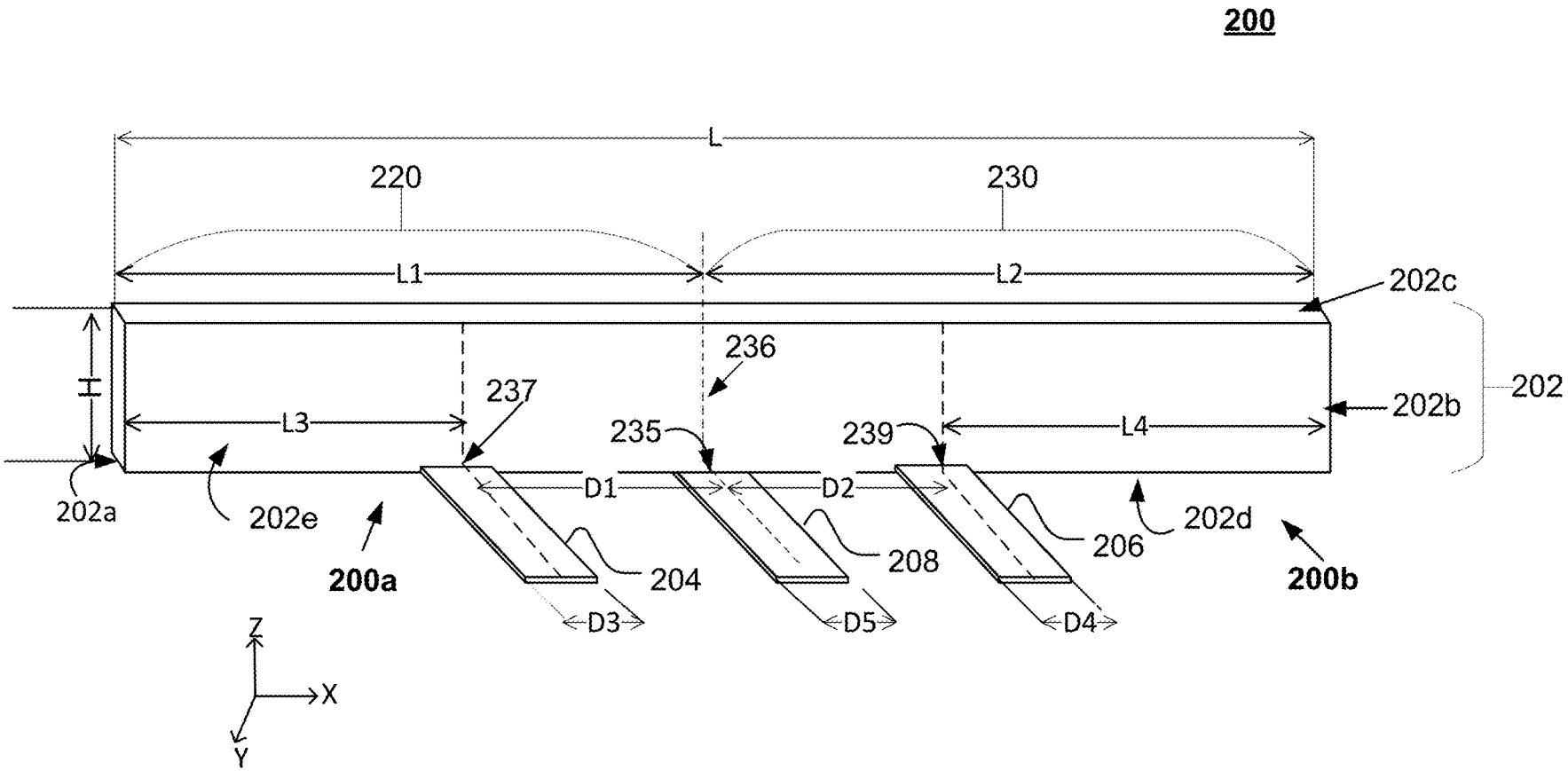
FIG. 2A is a front perspective view of an antenna device according to example embodiments.
Figure 2B:
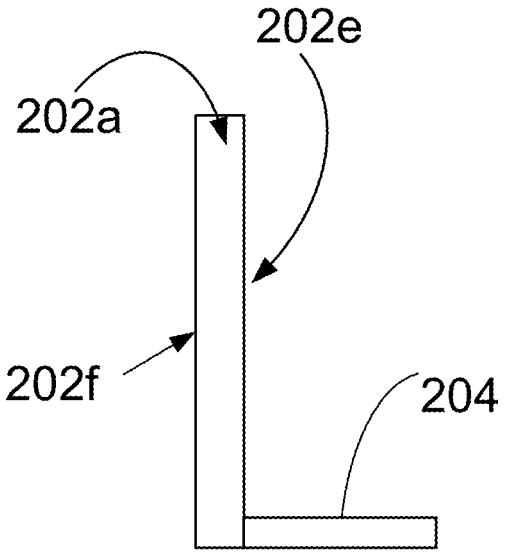
FIG. 2B is a left side view of the antenna device in FIG. 2A.
Figure 2C:
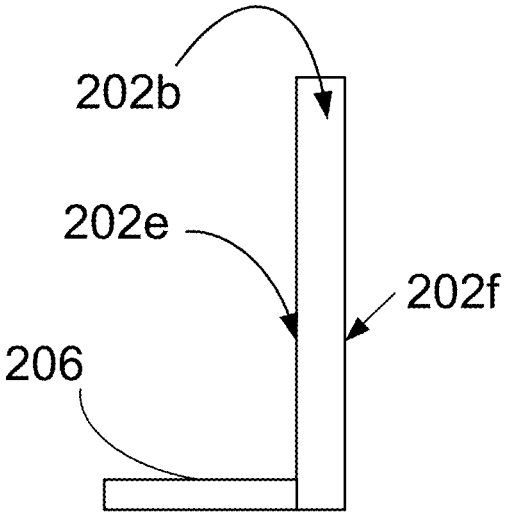
FIG. 2C is a right side view of the antenna device in FIG. 2A.

FIGS. 2A-2C illustrate an example embodiment of antenna device 200 for radiating radio wave signals. The antenna device 200 includes a radiator 202 that functions as a first antenna 200*a* for radiating a first radio wave signal within a first target frequency band and a second antenna 200*b* for radiating a second radio wave signal within a second target frequency band. A ground terminal 208 is directly connected (i.e. without any intervening structural elements) to the radiator 202 between a first end 202*a* and a second end 202*b* of the radiator. A first feed terminal 204 is directly connected to the radiator at a first feed point 237 between the first end 202*a* and the ground terminal 208 for conducting a first electric current signal that corresponds to the first radio wave signal. A second feed terminal 206 is directly connected to the radiator at a second feed point 239 between the second end 202*b* and the ground terminal 208 for conducting a second electric current signal that corresponds to the second radio wave signal. During operation, radiator 202 functions as first antenna 200*a* to provide an interface that between the first electric current signal and the first radio wave signal. Simultaneously, the radiator 202 functions as second antenna 200*b* to provide an interface between the second electric current signal and the second radio wave signal.

In example embodiments, the antenna device can be used for transmitting radio wave signals into a wireless medium, for receiving radio wave signals from the wireless medium, or both. When used to transmit radio wave signals, the radiator 202 receives first and second electric current signals through first and second feed terminals 204, 206, respectively, from the transceiver circuit 120 of the electronic device. Radiator 202 converts the electromagnetic (EM) energy of the first electric current signal into the first radio wave signal and converts the EM energy of the second electric current signal to the second radio wave signal, thereby radiating the first and second radio wave signals into a wireless medium. When used to receive radio wave signals, the radiator 202 converts the EM energy from incoming external first and second radio wave signals to output corresponding first and second electric current signals to respective feed terminals 204, 206 for guided transmission to the transceiver circuit 120.

In the example of FIGS. 2A-2C, the radiator 202 is a single, discrete, planar conductive element having a rectangular profile. As shown in FIG. 2A, radiator 202 has first and second ends 202*a*, 202*b*, top and bottom edges 202*c* and 202*d* that extend between first and second ends 202*a*, 202*b*, a planar inner side 202*e*, and a planar outer side 202*f*. In the illustrated embodiment, the radiator 202 has a uniform thickness such that planar inner side 202*e* and planar outer side 202*f* are parallel to each other. In the illustrated embodiment of FIGS. 2A-2C, the radiator 202 is a continuous rectangular element that does not include any slots or holes or other openings through its body. However, in some alternative embodiments there may openings through the radiator 202. Although shown in FIG. 2A as having 90 degree corners, in some examples the radiator 202 could be oblong or have rounded or chamfered corners, and it will be understood that in some examples the rectangular radiator 202 may not have perfect rectangular properties but may instead have a shape that approximates a planar rectangular element. Furthermore, as shown in FIG. 2A the radiator 202 extends in a common plane from its first ends 202*a* to its second end 202*b*. However, in some examples, the radiator 202 may have a curvature along its length, or its height.

As shown in FIG. 2A, the first feed terminal 204, second feed terminal 206, and the ground terminal 208 are located between the first radiator end 202*a* and the second radiator end 202*b*, with ground terminal 208 located between the first feed terminal 204 and the second feed terminal 206. The first feed terminal 204, second feed terminal 206, and the ground terminal 208 are each electrically connected to the radiator 202 at or close to the bottom edge 202*d*. Each terminal 204, 206, 208 is a rectangular conductive tab that extends from radiator inner side 202*e*. In some examples, the terminals 204, 206, 208 are each connected by a respective physical joint such as a welded joint, which may for example be at a right angle to the radiator 202. In some embodiments, the radiator 202 and the terminals 204, 206 and 208 are stamped or cut from a single sheet of conductive material, and during assembly, the terminals 204, 206, 208 are bent to extend at a right angle to the radiator 202. In some examples the conductive material that the radiator 202 and the terminals 204, 206 and 208 are made of is a metal such as copper.

In the example of FIGS. 2A-2C, the first feed terminal 204, second feed terminal 206, and the ground terminal 208 are perpendicular to the inner side 202*e* of the radiator 202. Referring to the orthogonal X, Y, Z reference coordinate system in FIG. 2A, the inner side 202*e* of the radiator 202 is on, or parallel to, the XZ plane, and the first feed terminal 204, second feed terminal 206, and the ground terminal 208 are parallel to, or on the XY plane.

In FIG. 2A, the radiator 202 is illustrated as having a length L, with a first antenna portion 200*a* extending a length L1 from a center 235 of ground terminal 208 to the first end of 202*a* of the radiator 202, and a second antenna portion 230 extending a length L2 in the opposite direction from the ground terminal center 235 to the second end of 202*b* of the radiator 202. The center of the first feed point 237 for the first antenna portion 200*a* is located a distance D1 from the ground terminal center 235, and the center of the second feed point 239 for the second antenna portion 200*b* is located a distance D2 in the opposite direction from ground terminal center point 235. The ground terminal 208 creates a grounded region 236 in the area where first and second antenna portions 200*a*, 200*b* meet. As shown in FIG. 2A, first antenna portion 220 extends a distance L3 beyond first feed point 237 (i.e. L3=L1−D1), and second antenna portion 230 extends a distance L4 beyond second feed point 239 (i.e. L4=L2−D2).

The widths of the first and second feed terminals 204 and 206, and the ground terminal 208 are D3, D4, and D5, respectively. In some examples the widths of the widths of the first and second feed terminals 204 and 206, and the ground terminal 208 are the same, i.e. D3=D4=D5. The widths of terminals are selected to provide suitable electrical connections between the antenna device 200 and the respective signal and feed paths of the RF communications circuit 114, and also to reduce coupling and interference between the terminals. In one non-limiting example, D3=D4=D5=2 mm.

As will be discussed in greater detail below, in example embodiments, the RF signal antenna device 200 is integrated into or securely attached to side edge or rim portions of housing 102, and the height H of the radiator 202 is selected in accordance with the height of the side rim of the electronic device 100.

During the design of antenna device 200, the dimensions L1, D1 and L3 of first antenna portion 220 are selected to enable the radiator 202 to radiate first radio wave signals that fall within a first target frequency band BW1, and also to enable the antenna device 200 to achieve target performance criteria such as impedance matching. Similarly, the dimensions L2, D2, and L4 of second antenna portion 230 are selected to enable the radiator 202 to radiate second radio wave signals that fall within a second target frequency band BW2, and also to enable the antenna device 200 to achieve target performance criteria such as impedance matching.

Accordingly, in example embodiments the single radiator 202 functions as two antennas, namely first antenna 200*a* for first radio wave signals within a first target frequency band BW1, and second antenna 200*b* for second radio wave signals within a second target frequency band BW2. In an example configuration, radiator 202 is configured so that first antenna 200*a* and second antenna 200*b* both function as quarter-wavelength antennas. Thus, in example embodiments, the dimension L3 is selected to provide first antenna 200*a* with an effective resonating length of $\lambda_1/4$, where $\lambda_1$ is the wavelength of the resonating frequency $f_1$ for the first antenna 200*a*, and $f_1$ falls within the first target bandwidth BW1. Similarly, the dimension L4 is selected to provide second antenna 200*b* with an effective resonating length of $\lambda_2/4$, where $\lambda_2$ is the wavelength of the resonating frequency $f_2$ for the first antenna 200*b*, and $f_2$ falls within the first target bandwidth BW2. Due to the effects of coupling of the antennas 200*a* and 200*b* with each other as well as with other components within the device housing 102, the actual physical dimensions of the antenna components (for example antenna portions 220 and 230) will typically not be $\lambda_1/4$ or $\lambda_1/4$, respectively, but will instead be less than $\lambda_1/4$ or $\lambda_1/4$. Accordingly, in at least some example embodiments, lengths L3 and L4 are selected based on one or both of simulation results or experimentation. In one example design process, the length L3 of the first antenna portion 220 from the first feed point 237 to first end 202*a* (i.e. L3=L1−D1) is initially set at $\lambda_1/4$ and the length L4 of the second antenna portion 230 from the second feed point 239 to second end 202*b* (i.e. L4=L2−D2) is set at $\lambda_1/4$. The lengths L3 and L4 are each incrementally shortened based on the results of one or both of computer simulations and physical experimentations until a length L3 and a length L4 are determined that respectively optimize performance of radiator 202 for the frequency $f_1$ and the frequency $f_2$.

In example embodiments, during the design of the antenna device 200, the dimensions D1 and D2 are determined to enable antenna device 200 to achieve impedance matching with RF communications circuit 114 at the resonant frequencies $f_1$ and $f_2$. In this regard, the feed terminals are 204, 206 are positioned so that radiator 202 has an input impedance with a negligible reactance and a resistance that matches the output resistance of the RF communications circuit 114, without using any additional impedance matching circuit or impedance compensating circuit.

In example embodiments, impedance matching is achieved when any power loss in RF signals exchanged between radiator 202 and RF communications circuit 114 is within an acceptable threshold level at the resonant frequencies $f_1$ and $f_2$. In example embodiments, the power loss in signals exchanged between the antenna device 200 and RF communications circuit 114 is represented by a parameter $S_{11}$, which indicates the power level reflected from radiator 202.

In an example embodiment of impedance matching within an acceptable threshold level, for an RF communications circuit 114 with impedance R=50 ohms, each of feed terminals 237 and 237 present a resistance R of about 35 to 75 ohms, and a reactance X about −20 to +20 Ohm, at the resonant frequency of the antenna. For example, at the resonant frequency, the input impedance at each of feed terminals 237 and 237 may be a pure resistance, for example around 35-75 Ohms at the resonant frequency. In at least some embodiments, impedance matching that achieves power loss within an acceptable threshold level results in $S_{11}$<=−6 dB for radiator 202.

As will be appreciated from the above description, the radiator 202 of antenna device 200 is a single, elongate, discrete, rectangular conductive structure that implements first and second antennas 200*a*, 200*b* that respectively radiate radio wave signals of wavelengths λ1 and λ2. The wavelengths λ1 and λ2 correspond to respective resonant frequencies f1 and f2 that fall within target RF spectrum bands BW1, BW2. In some examples, at least one antenna implemented by the antenna device 200 targets RF signals with a sub-6 GHz resonant frequency. In some examples, one or both of the antennas 200*a*, 200*b* implemented by the antenna device 200 target the 3.5 GHz and/or 5 GHz bands that are allocated for WLAN RF signals. Although the exact spectrum bandwidth allocated by licensing bodies for the 3.5 GHz and 5 GHz bands may vary depending on geographic location, the 3.5 GHz band will generally fall within 3.4 GHz to 3.7 GHz and the 5 GHz band will generally fall within 4.8 GHz to 5.8 GHz. Accordingly, in some examples, f1 and f2 are selected to correspond to one or both of the 3.5 GHz or 5 GHz bands. In one example embodiment, radiator 2002 is balanced and the antennas 200*a*, 200*b* both target the 5 GHz band, and L1=L2, D1=D2, L3=L4. In another example embodiment, radiator 2002 is balanced and the antennas 200*a*, 200*b* both target the 3.5 GHz band, and L1=L2, D1=D2, L3=L4. In another example embodiment, the radiator 2002 is unbalanced and the antennas 200*a*, 200*b* each target a respective one of the 3.5 GHz band and 5 GHz band, and L1≠L2, L3≠L4. In an unbalanced configuration, one of the antenna portions 220 or 230 will be longer than the other one of the antenna portions 230 or 220. In particular, the antenna portion (for example 220) that corresponds to the lower frequency band will be longer than the antenna portion (for example 230) that corresponds to the higher frequency band, with the result that the ground terminal 208 will be located closer to one end of the radiator (for example 202*b*) than the other end (for example 202*a*).

In one example embodiment of a balanced radiator 202 in which both antennas 200*a* and 200*b* implemented by radiator 202 target the 3.5 GHz frequency band, the radiator 202 has a total length of L=35 mm, with L1=L2=17.5 mm, D1=D2=3.5 mm and L3=L4=14 mm. It will be noted that L3 and L4 (14 mm) are each less than ¼ wavelength of a 3.5 GHz signal. This difference is a result of the dimensions of radiator 200 being selected during the design process to compensate for coupling between the antenna portions 220, 230 and coupling of the antenna portions 220, 230 with other elements in housing 102. In this example, the antenna device 200 has a resistance R about 35 to 75 Ohm, and a reactance X about 0 to +/−20 Ohm, and $S_{11}$<=−6 dB. As well, the antenna device 200 in this example has a high efficiency. According to measurement results, at 3.5 GHz resonant frequency, radiator 202 may have a total Rx efficiency of about 70%, and the correlation between antenna portions 220 and 230 is below 0.2. In some example embodiments, the radiator 202 has a total length of L=35 mm+/−15%, with L1=L2=17.5 mm+/−15%, D1=D2=3.5 mm+/−15% and L3=L4=14 mm+/−15%.

In some examples, the radiator 202 could be configured to implement more than two antennas. For example, radiator 202 could be formed with three or more oblong arms extending from a central section that has a ground terminal. Each of the oblong arms could have a respective feed terminal and function as an independent antenna.

Figure 3A:
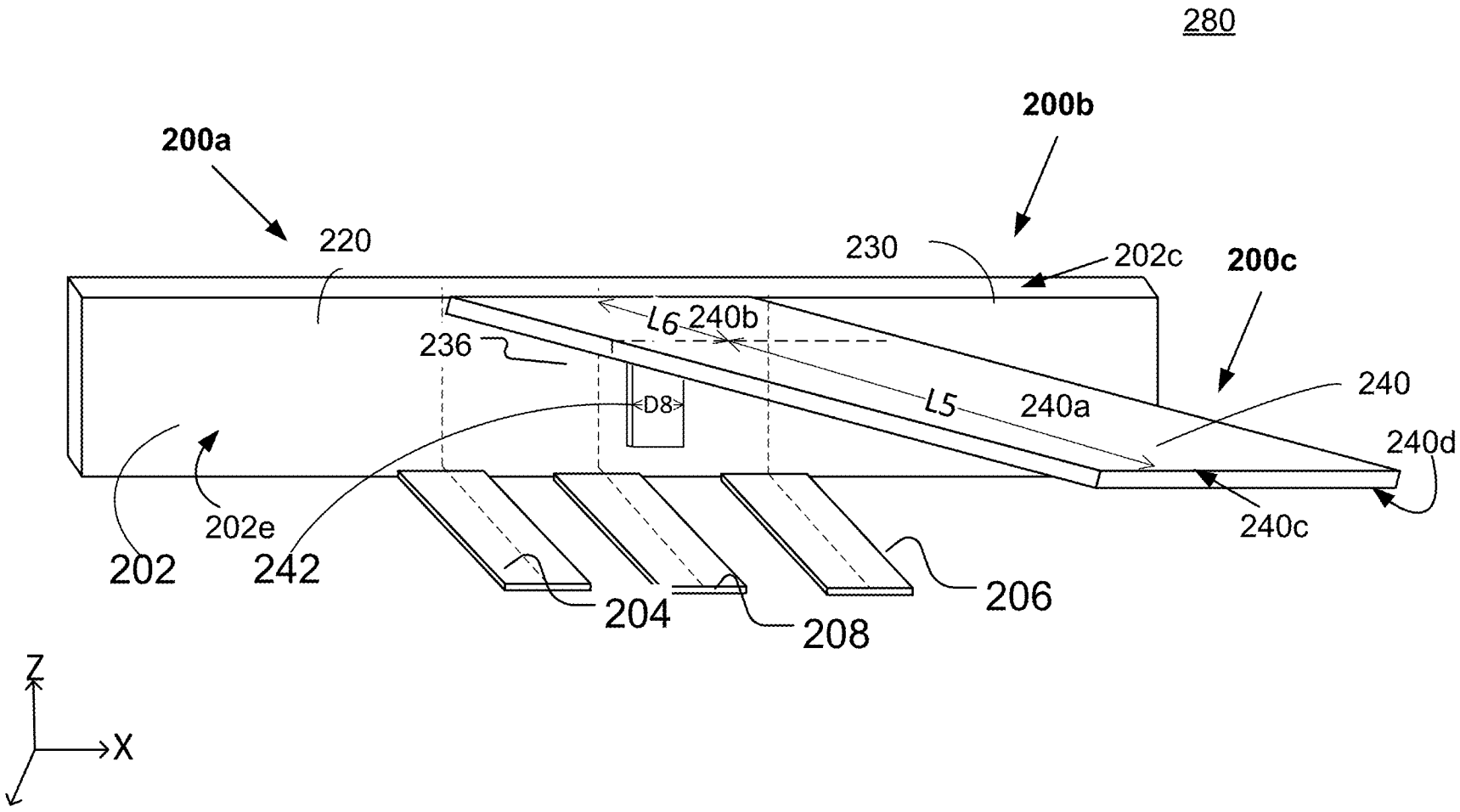
FIG. 3A is a perspective view of another antenna device according to example embodiments.
Figure 3B:
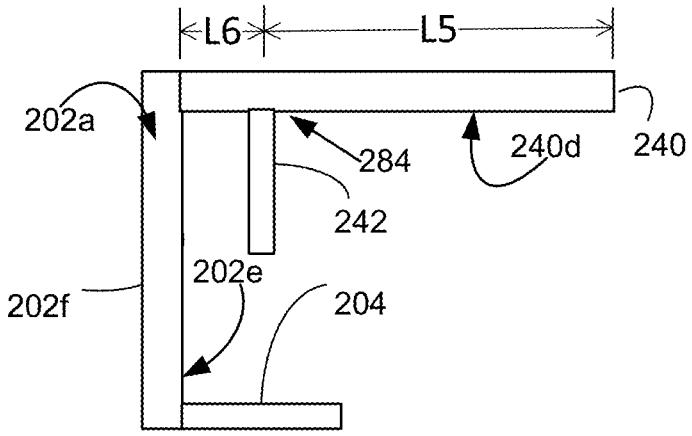
FIG. 3B is a left side view of the antenna device of FIG. 3A.
Figure 3C:
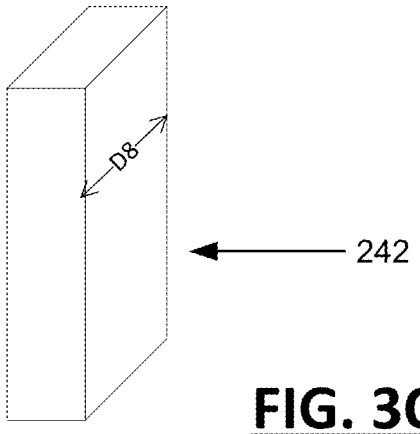
FIG. 3C is an enlarged perspective view of the third feed terminal of the antenna device of FIG. 3A.

FIGS. 3A-3C illustrate another example embodiment of an antenna device 280. Antenna device 280 is the same as antenna device 200 except that a third antenna portion 240 is connected to radiator 202, enabling the antenna device 280 to implement a third antenna 200*c* in addition to the two antennas 200*a*, 200*b* implemented by radiator 202. In antenna device 280 of FIGS. 3A-3B, the third antenna portion 240 is a planar rectangular metal arm having a first end connected close to the radiator top edge 202*c*.

A third feed terminal 242 is electrically connected to the third antenna portion 240 at a third feed point 284 (FIG. 3B) that is spaced a distance L6 from the radiator 202. The third antenna portion 240 may be perpendicular to the inner surface 202*e*, and the third feed terminal 242 may be perpendicular to the third antenna portion 240. In the embodiment shown in FIGS. 3A-3C, the third feed terminal 242 is a rectangular metal tab, and has a width D8 that in at least some examples is the same width as the width of first and second feed terminals 204, 206. An electrical ground connection for the third antenna portion 240 is provided by radiator ground terminal 208 through the grounded region 236 of the radiator 202.

The third antenna portion 240 includes two sub-portions: first sub-portion 240*a*, which has a length L5 and extends from the third feed point 284 to a distal end 240*c* of the antenna portion 240*a*; and second portion 240*b*, which has the length L6 between the third feed point 284 and radiator 202. In some examples, dimensions L5 and L6 are selected during antenna design to provide an effective length of $\lambda_3/4$, where $\lambda_3$ corresponds to a third resonating frequency $f_1$ that falls within a target RF frequency band BW3, and to meet performance criteria such as impedance matching. The dimensions L5 and L6 of antenna portion 240 can be determined to meet resonant frequency and impedance matching criteria in the same manner as set out above in respect of antenna portions 220 and 230.

Figure 3D:
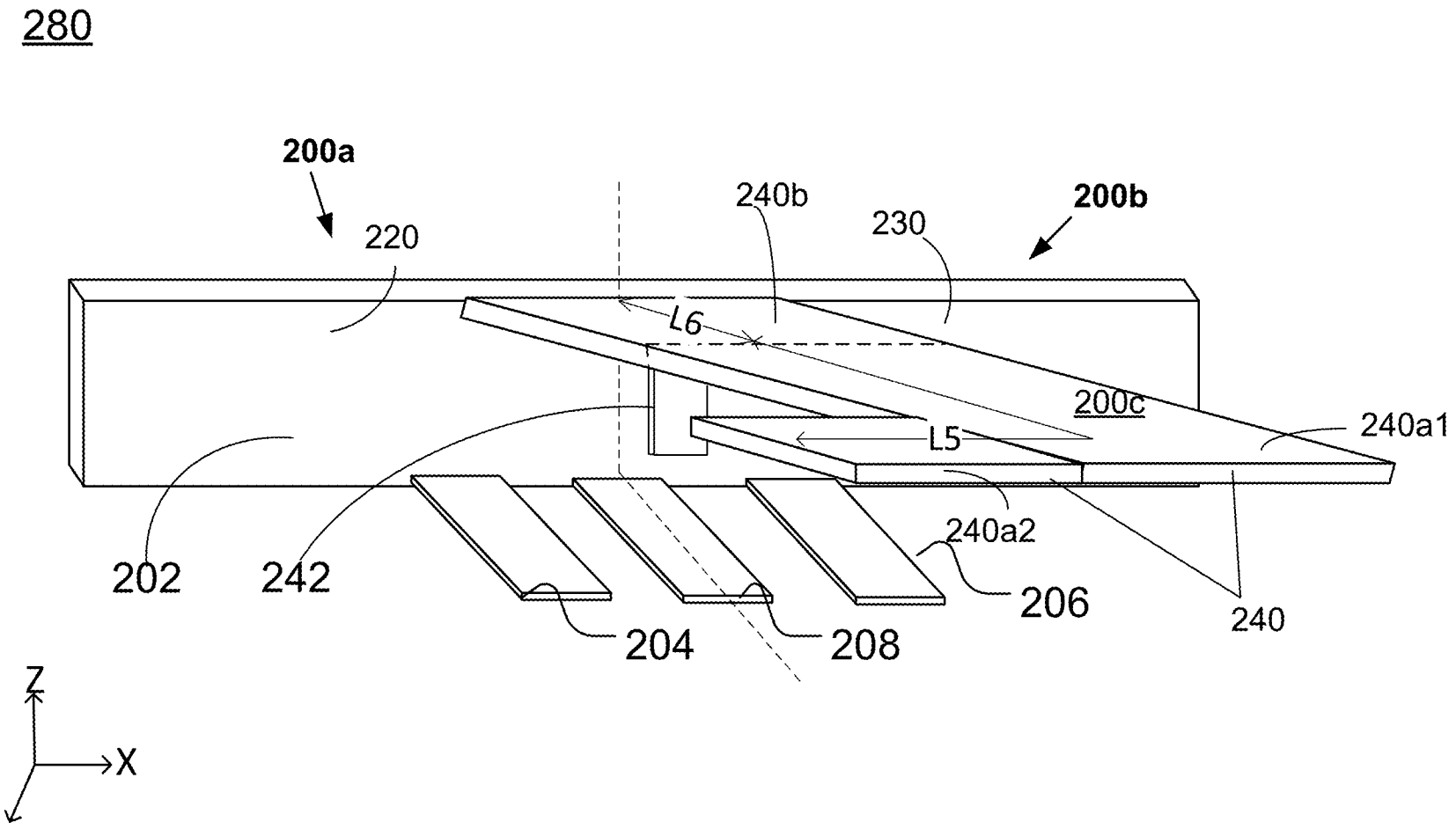
FIG. 3D is a perspective view of another antenna device according to example embodiments.

Referring to FIG. 3D, in a further example embodiment of antenna device 280, third antenna portion 240 may include a bend along its length to form an L-shaped antenna structure. In FIG. 3D, the first sub-portion 240*a* of antenna portion 240 has an L-shaped configuration that includes co-planar first and second regions 240*a*1, 240*a*2. Second region 240*a*2 may extend substantially perpendicular to, but in the same plane as, the first region 240*a*1. The first region 240*a*1 and second region 240*a*2 collectively have a length L5. By angling the second region 240*a*2 with respect to the first region 240*a*1, each region 240*a*1, 240*a*2 has a length less than L5, which may increase the isolation distance between the different antenna portions 200*a*, 200*b*, 240, and thus may improve correlations between the antenna portions.

Accordingly, the antenna device 280 in the examples of FIGS. 3A-3C and 3D functions as three antennas 200*a*, 200*b* and 200*c*. The third antenna 200*c* radiates RF signals of wavelength $\lambda_3$, which may be the same as or different than $\lambda_1$ or $\lambda_2$. Through its connection to grounding region 236, antenna portion 240 shares the common ground terminal 208 of antenna device 280 with antenna portions 220, 240.

Figure 4:
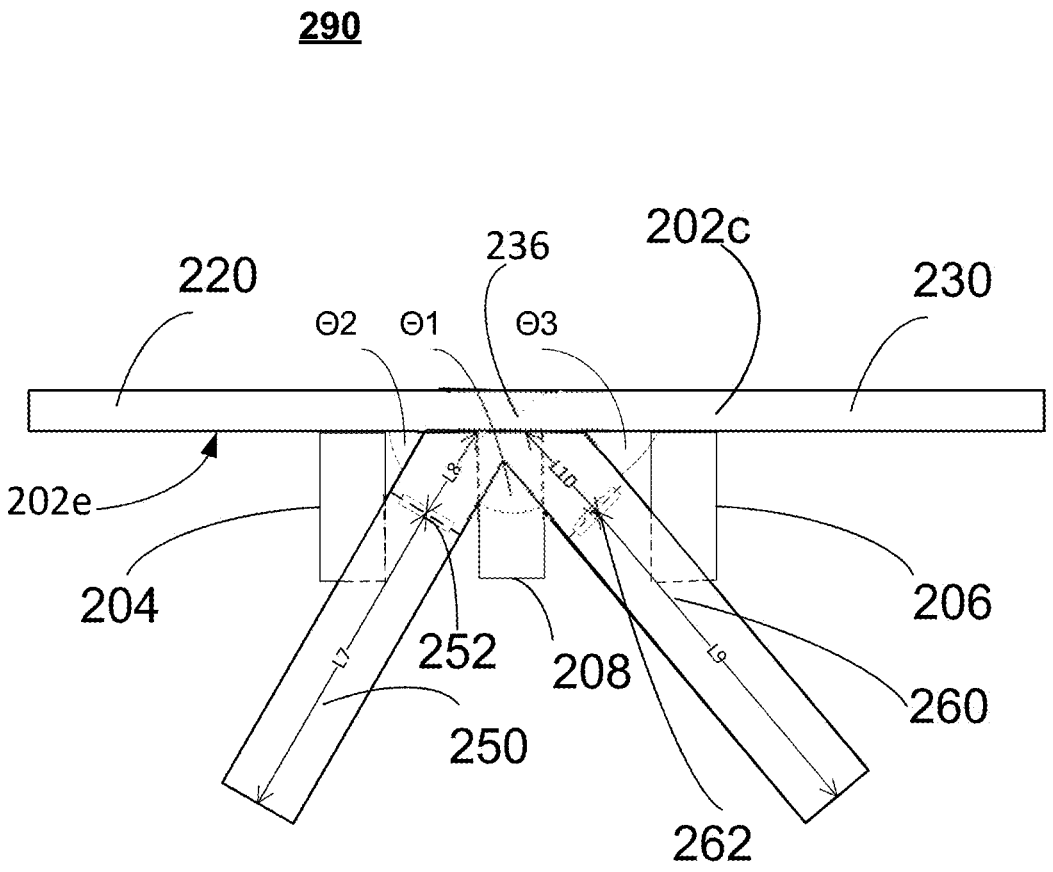
FIG. 4 is a top view of another antenna device according to example embodiments.

FIG. 4 illustrates another antenna device 290. Antenna device 290 is similar to antenna device 280 except that the antenna device 290 includes a fourth antenna. In particular, the antenna device 290 includes two antenna portions 250 and 260 connected to the top edge 202C of radiator 202 in the place of the third antenna portion 240 of antenna device 280. As shown in the example embodiment of FIG. 4, the antenna portions 250 and 260 are rectangular arms that extend at angles Θ2 and Θ3, respectively, from inner surface 202*e* of radiator 202. In the illustrated embodiment, antenna portions 250 and 260 are each electrically connected to the grounding region 236 at the top edge 202*c*. An angle Θ1 exists between the antenna portions 250 and 260. In one embodiment, Θ1=Θ2=Θ3=60 degrees. Each antenna portion 250, 260 has a respective feed terminal 252, 262. The feed terminal 252 of the antenna portion 250 is located a distance L7 from a distal end of the antenna portion 250 and a distance L8 from the radiator surface 202*e*. The distance L7 is selected based on the wavelength of the RF signals that the antenna portion 250 is targeted to radiate, and the distance L8 is selected during the design of the antenna portion to provide an impedance matching state for antenna portion 250. Similarly, the feed terminal 262 of the antenna portion 260 is located a distance L9 from a distal end of the antenna portion 260 and a distance L10 from the radiator surface 202*e*. The distance L9 is selected based on the wavelength of the RF signals that the antenna portion 260 is targeted to radiate, and the distance L10 is selected during the design of the antenna portion to provide an impedance matching state for antenna portion 260. The dimensions L7, L8, L9, L10 can be selected during antenna portion design using the same criteria set out above in respect of antenna device 200.

The antenna device 290 in the example of FIG. 4 functions as four antennas. In further example embodiments, the antenna device element 202 can be designed with more than four antenna portions, as long as the correlation between the antenna portions formed by respective arms is within an acceptable correlation level, such as 0.2 or less at the respective resonant frequencies of the antenna portions.

In some example embodiments, the antenna devices 200, 280 and 290 are designed to operate in a balanced mode, and in some example embodiments the antenna devices 200, 280, 290 are designed to operate in an unbalanced mode. In balanced mode, each of the antenna portions in an antenna device targets the same RF spectrum band, for example the 3.5 GHz or 5 GHz bands. In unbalanced mode, at least one of the antenna portions of the antenna device radiates RF signals of a different target frequency band than one or more of the other antenna portions.

The multiple antenna solution described above may in some configurations have a more compact size than other antenna solutions that require a radiator and ground terminal for each antenna. In at least some configurations, the antennas of the antenna device 200 in the example of FIG. 2A have an acceptable correlation threshold level, for example Rx-Rx Envelope Correlation Coefficient between antenna portions 200*a* and 200*b* is below 0.2 at 3.5 GHz. Therefore, RF signal antenna device 200 may be implemented in an electronic device 100, such as a 5G electronic device, without occupying excessive space on the PCB 104 or requiring extensive changes to the design of an existing PCB layout.

MIMO Antenna Portion Arrays

In example embodiments, antenna devices such as one or more of antenna devices 200, 280 and 290 are integrated into electronic devices to implement MIMO antenna portion arrays. In this regard, FIGS. 5 and 6 illustrate example embodiments of a MIMO antenna portion array that includes a plurality of antenna portions formed by antenna devices 200 (shown as antenna devices 200(*i*), where i=1, 2, 3 or 4) integrated into the housing 102 of electronic device 100.

Figure 5:
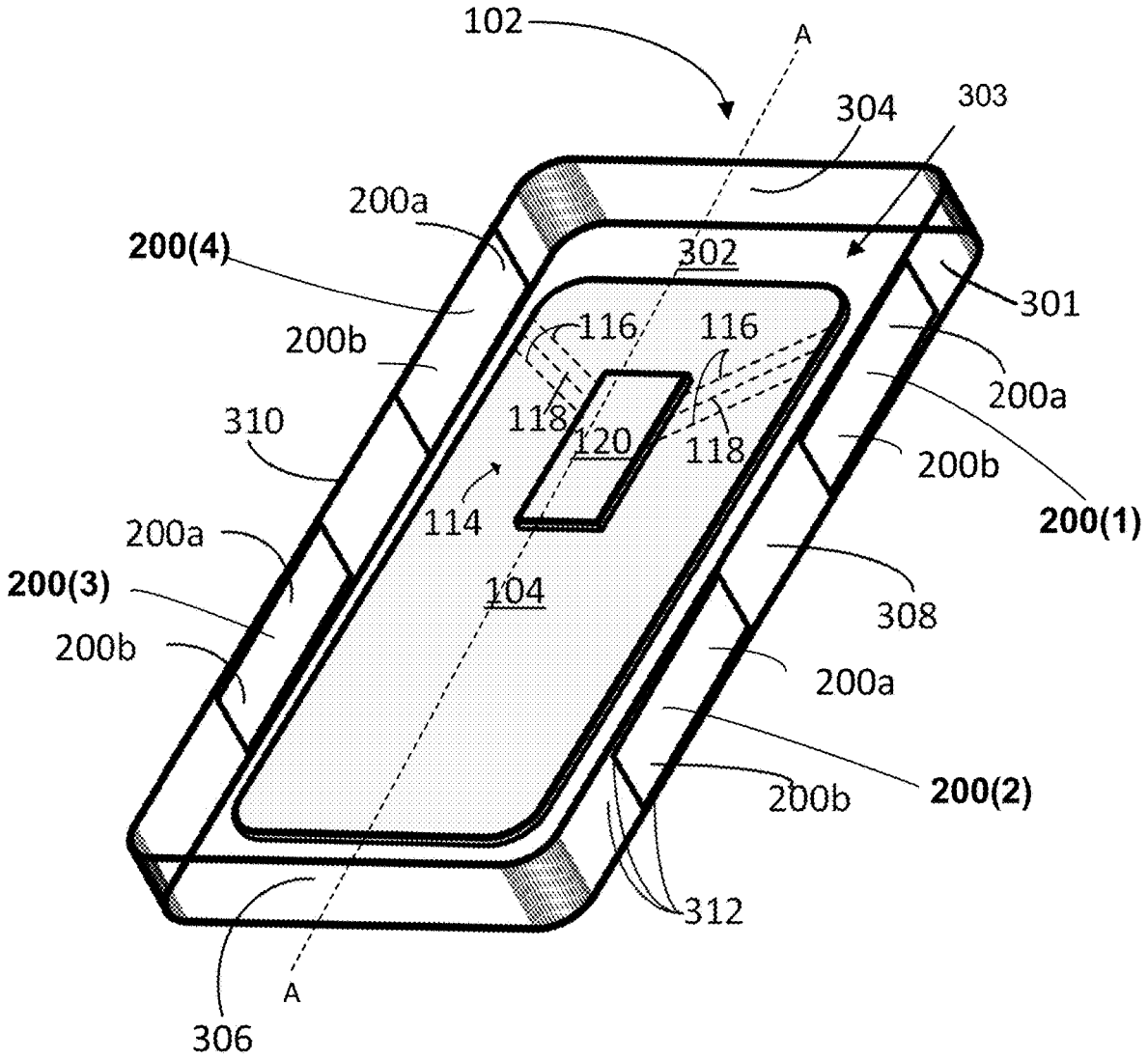
FIG. 5 is a front perspective view of a housing of the electronic device in FIG. 1, illustrating two antenna devices attached to each of two side rims, according to example embodiments.
Figure 6:
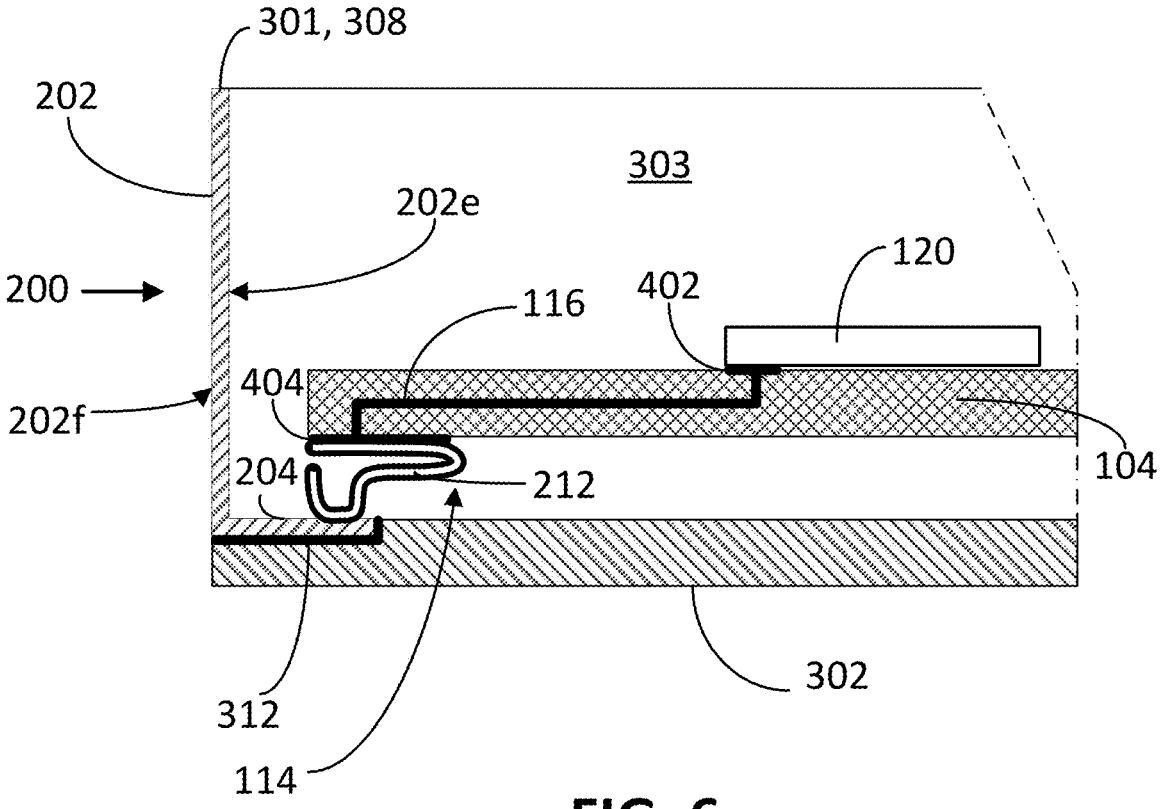
FIG. 6 is a partial cross-sectional view of FIG. 5, illustrating an antenna device with a feed terminal connected to a signal circuit, according to example embodiments.

In FIGS. 5 and 6, the housing 102 of electronic device 100 includes a rectangular, planar back enclosure element 302 that is surrounded by a forwardly projecting rim 301 that extends around the outer periphery of back enclosure element 302. The rim 301 and back enclosure element 302 define the back and sides of an internal region 303 that contains hardware of the device 100, including PCB 104. As noted above, the electronic device 100 will typically also include a front enclosure element (not shown) secured on the front of the rim 301 that covers the front of the internal region 303 to enclose the internal device hardware. However, in the illustration of FIG. 5, the front enclosure element is omitted for clarity. In at least some examples the front enclosure element incorporates user interface elements such as a touch display screen.

The rim 301 includes a top rim portion 304, a bottom rim portion 306 and two opposite side rim portions 308 and 310 that extend between the top and bottom rim portions. Electronic devices intended for handheld use typically have a rectangular prism configuration with a top and bottom of the device that correspond to the orientation that the device is most commonly held in during handheld use, and the terms "top", "bottom", "front" and "back" as used herein refer to the most common use orientation of a device as intended by the device manufacturer, while recognizing that some devices can be temporarily orientated to different orientations (for example from a portrait orientation to a landscape orientation).

Each of the top rim portion 304, the bottom rim portion 306, and the two opposite side rim portions 308 and 310 has an inner surface and an outer surface. In an example embodiment, the back enclosure element 302 and the rim 301 are formed from suitable material, such as metal, plastic, carbon-fiber materials or other composites, glass, or ceramics. Two antenna devices 200(1), 200(2) are secured to one side rim portion 308 and two antenna devices 200(3), 200(4) are secured to the other side rim portion 310. As noted in the description above, each antenna device 200(1) to 200(4) functions as two antennas, and accordingly the group of four antenna devices forms an 8×8 MIMO antenna array. The feed terminals 204 and 206 and the ground terminal 208 of each of the 8 antenna portions are electrically connected with respective signal paths 116 and ground paths 118 of PCB 104.

As illustrated in the example embodiment of FIG. 5, the rim 301 is a metal rim and the antenna devices 200(1) to 200(4) are each integrated into the rim 301 with the inner side 202*e* of each antenna device facing into the internal region 303 of housing 102 and the outer side 202*f* of each antenna device facing outwards from the housing 102. In one example, the antenna devices 200 are integrated into the rim 301 during device assembly by securing each antenna device into a respective opening in the side rim portions 308 and 310 using an insert molding process. During the insert molding process, an insulating dielectric material 312 (see antenna device 200(2)) is molded around a perimeter of each antenna device to insulate the RF signal antenna device 200 from the rest of the metal of rim 301 and secure the RF signal antenna device 200 in place. In some examples, insulating material 312 could include a plastic strip. In an example embodiment the antenna devices 200(1)-200(2) are evenly spaced apart in a row alongside rim portion 308 and the antenna devices 200(3)-200(4) are evenly spaced apart in a row along opposite side rim portion 310. In the example illustrated in FIG. 5, the inner side 202*e* of the radiator 202 of each of the antenna devices 200(1)-200(4) forms part of the inner surface of the rim 301, and the outer side 202*f* of the radiator 202 of each of the antenna devices 200(1)-200(4) forms part of the outer surface of the rim 301. In an embodiment, the thickness of the radiator 202 of the antenna devices 200(1)-200(4) and the non-antenna portions of side rim portions 308 and 310 are the same, however in some example embodiments they may be different.

As noted above, an RF transceiver circuit 120 is mounted on PCB 104. Signal paths 116 and ground paths 118 (illustrated as dashed lines in FIG. 5, which shows two sets of signal and ground paths 116, 118) extend through the PCB 104 from the RF transceiver circuit 120 to the antenna devices 200. Each set of signal and ground paths 116, 118 in FIG. 5 includes two signal paths 116 and one ground path 118.

FIG. 6 is a partial cross-sectional illustration of the device 100 of FIG. 5, showing the connection of feed terminal 204 of a antenna device 200 (for example antenna device 200(3)) to transceiver circuit 120 through a signal path 116 of PCB 104. As noted above, the radiator 202 of the antenna device 200 forms part of the rim 301 (side rim portion 308 in the case of antenna device 200(3)) of housing 102, with the inner side 202*e* of the radiator 202 facing housing inner region 303, and the outer side 202*f* of the radiator 202 facing outwards. The feed terminal 204 of RF signal antenna device 200 extend inward from the radiator 202 and is integrated into an upper surface of the bottom enclosure element 302 such that a surface of the feed terminal 204 is exposed in housing inner region 303. In the illustrated embodiment, the bottom enclosure element 302 is metal and dielectric insulating material 312 extends between the metal bottom enclosure 302 and the components of the antenna device 200 (including feed terminals 204 and 206 and ground terminal 208) to insulate the antenna device components from the metal bottom enclosure element 302.

In the embodiment of FIG. 6, signal path 116 extends through PCB 104 between a first conductive pad 402 located on one side of the PCB 104 and a second conductive pad 404 located on the opposite side of the PCB. A signal input/output pad of RF transceiver circuit 120 is electrically connected, (for example, with a soldered connection) to the first conductive pad 402. A connector, such as a spring loaded pressure contact connector, 212 is electrically connected (for example, with a soldered connection) to the second conductive pad 404. During a device assembly process, the PCB 104 is secured within the housing 102 (which may occur through known techniques such as screws and/or clips for example), and the spring loaded connector 212 is clamped between the PCB 104 and the antenna device feed terminals 204. The connector 212 is biased into electrical contact with feed terminal 204 thus providing a RF signal path between the RF transceiver circuit 120 and the feed terminal 204 of antenna device 200. Although not shown in FIG. 6, each of the feed terminal 206 and ground terminal 208 of RF signal antenna device 200 is similarly electrically connected by a further spring loaded connector to a signal path 116 and a ground path 118, respectively.

The spring loaded connectors 212, PCB signal path 116 and ground path 118, RF transceiver circuit 120, and any interconnecting conductive elements such as PCB pads 402, 404, collectively are the RF communications circuit 114. As noted above in example embodiments, the impedance of RF signal antenna device 200 is matched as per the criteria described above to the impedance of the RF communications circuit 114. In at least some example embodiments, the impedance of the connectors 212, PCB paths 116 and 118 and any interconnecting conductive elements such as PCB pads 402, 404 is generally negligible and can be ignored in impedance matching of the RF signal antenna device 200 and the RF transceiver circuit 120.

Different electrical connections can be used between the antenna device 200 and the PCB 104 than the spring clip style connector 212 shown in FIG. 6. For example, a spring loaded pogo-pin style connector could alternatively be used.

Figure 7:
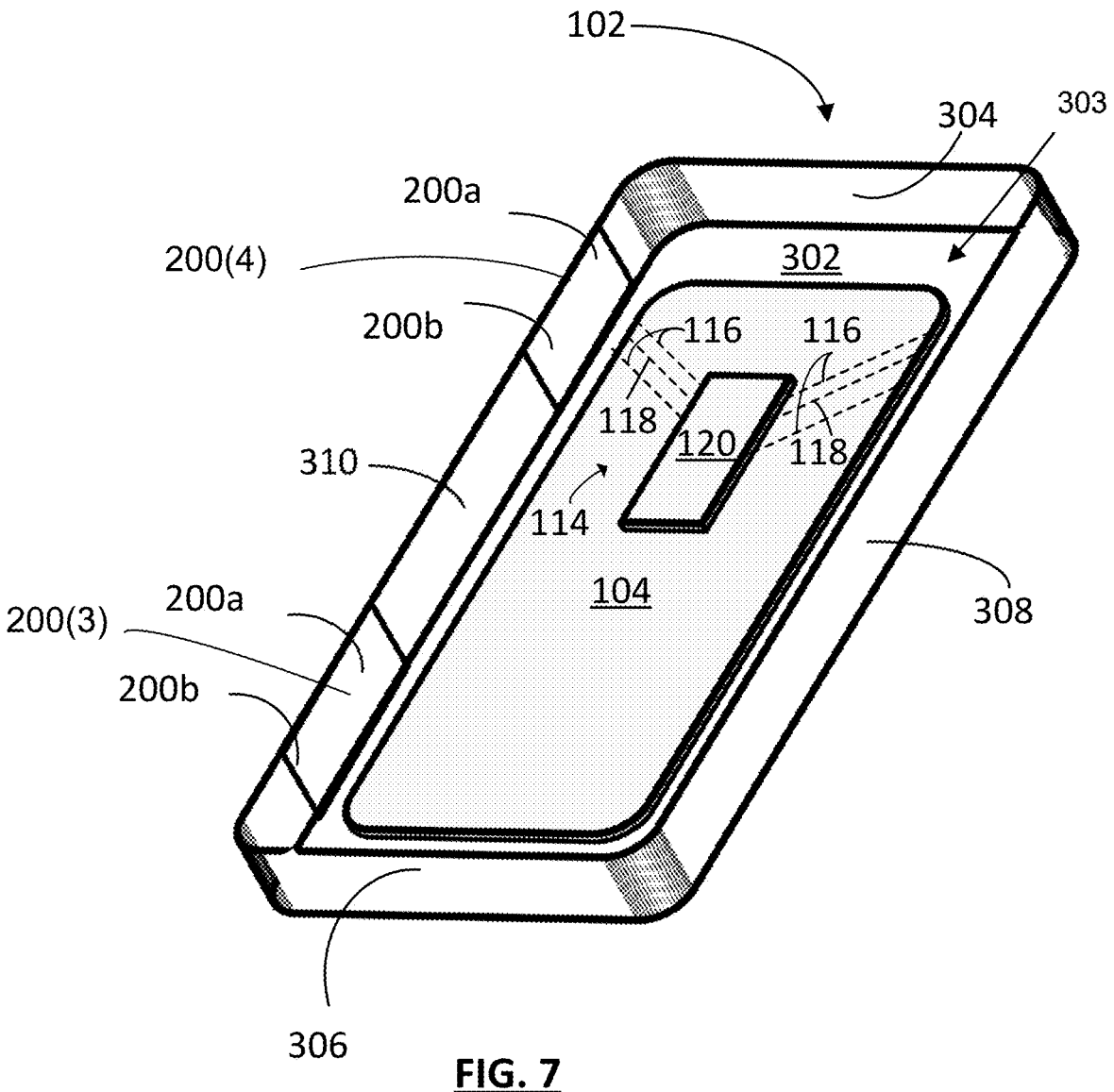
FIG. 7 is a front perspective view of a housing of a further example embodiment of the electronic device in FIG. 1, illustrating 2 antenna devices attached to an inner wall of each of two plastic side rims of the housing.
Figure 8:
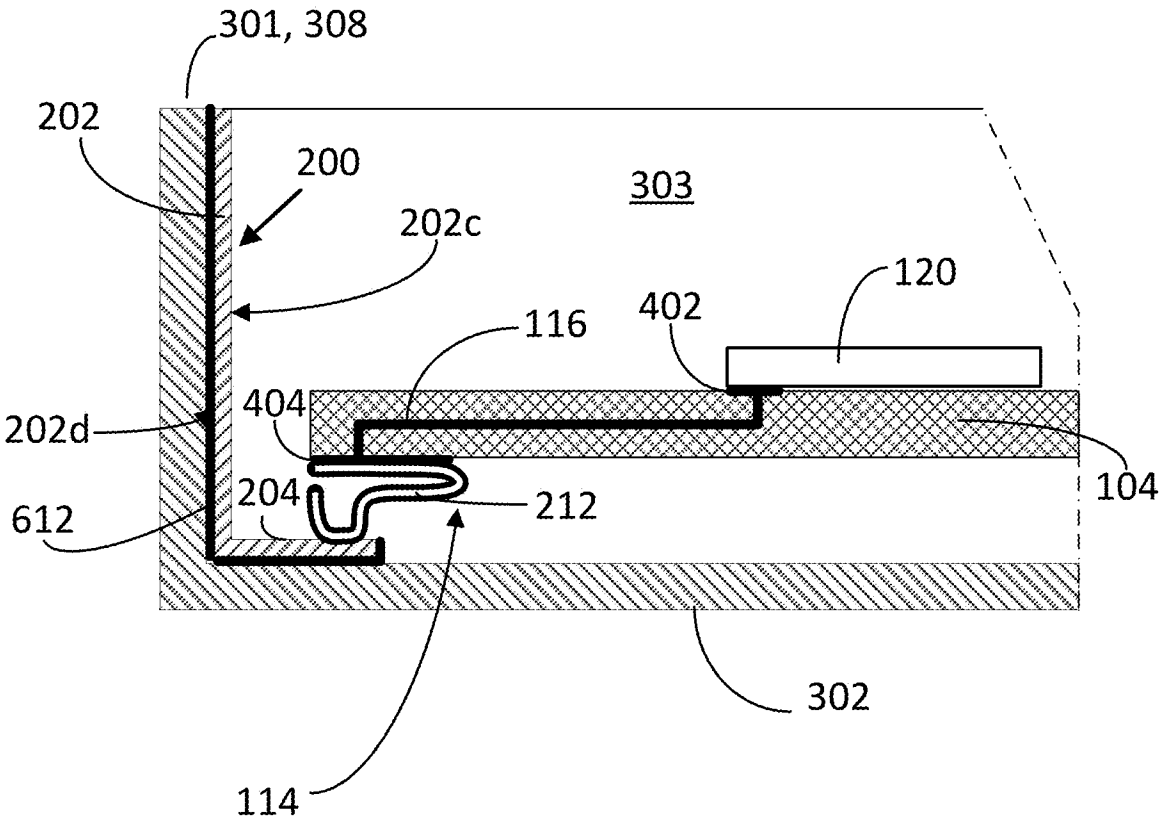
FIG. 8 is a partial cross-sectional view of FIG. 7, illustrating an antenna device with a feed terminal connected to a signal circuit, according to example embodiments.

In the embodiment of FIGS. 5 and 6, the rim 301 and bottom enclosure 302 of electronic device housing 102 are metallic components. FIGS. 7 and 8 illustrate a further example embodiment that is the same as the embodiment of FIGS. 5 and 6 except that the rim 301 and bottom enclosure 302 of electronic device housing 102 are made from plastic or other non-conductive material. As illustrated in FIG. 7, antenna devices 200(3) and 200(4) are secured to the inner surface of side rim portion 310 of the housing 102. Similarly, antenna devices 200(1) and 200(2) (which are not visible in the perspective view of FIG. 7) are secured to the inner surface of opposite side rim portion 308. In example embodiments of the device of FIG. 7, the antenna devices 200(1)-200(4) are secured to the inner surfaces of side rim portions 308 and 310 using a laser direct structuring (LDS) process. In another embodiment, the antenna devices 200 (1)-200(4) are secured to the inner surfaces of side rim portions 308 and 310 by a flex tape process in which each of the antenna devices 200(1)-200(4) is mounted on a respective flex PCB that is mounted to the inner surface of the side rim portion with an adhesive.

The partial sectional view of FIG. 8 illustrates an RF signal antenna device 200 (for example antenna device 200(3)) mounted to the plastic side rim portion 308 of rim 301 in greater detail. As shown in FIG. 8, the radiator 202 of antenna device 200 is secured to the inner surface of rim portion 308, with the inner side 202*e* facing housing inner region 303, and the outer side 202*f* facing the rim portion 308, which is formed from a non-conductive RF-transparent material. The feed terminal 204 extends inward from the radiator 202 along a non-conducting upper surface of the bottom enclosure element 302 such that a surface of the feed terminal 204 is exposed in housing inner region 303. In an example where an LDS process is used, the RF signal antenna device 200 may be integrally formed on the rim portion 308 and bottom enclosure element 302.

In an example where a flex tape process is used, RF signal antenna device 200 can be integrated into a flex PCB that is secured with adhesive to the rim portion 308 and bottom enclosure element 302.

The electrical connection of the feed terminals 204 and 206 and ground terminal 208 to RF communications circuit 114 are the same as described above in respect of FIGS. 5 and 6.

In the embodiments shown in FIGS. 5 to 8, the PCB 104 of the electronic device 100 is generally arranged to be parallel to bottom enclosure element 302 and may be secured to standoffs that are located on the bottom enclosure element 302. The radiator 202 of the RF signal antenna device 200 is arranged substantially perpendicular to the feed terminals 204 and 208206, and ground terminal 208, and this arrangement facilitates enables connecting the antenna device 200 attached to the rim 301 of housing 102 to with the ground and feed paths of PCB 104 through spring loaded pressure contact connectors 212.

As will be appreciated from FIGS. 5-8, because the antenna devices 200 are mounted on the device rim 301 the radiators 202 do not take up space on the PCB 104. Accordingly, more antennas for different radio access technologies and RF bands can be included in an electronic device housing of specific dimensions than might be possible using different antenna configurations. Furthermore, new devices can be designed based on existing PCB layouts without requiring extensive redesign of the PCB layout.

In different embodiments, the number, location and relative spacing of antenna devices 200 within the housing 102 can be different than described above. For example, one or more antenna devices 200 may be placed on the top rim portion 304, the bottom rim portion 306, the back enclosure element 302 and/or the front enclosure element of the housing 102. The antenna devices 200 can be asymmetrically placed in some examples. In some examples, the number of antenna devices 200 could be as few as one and greater than four. In some examples, six antenna devices 200 may be included in housing 102 to form a 12×12 MIMO antenna portion array.

In some example embodiments of the housing 120 shown in FIGS. 5 and 7, the antenna devices 200 secured to the housing 102 are all identical to each other. In one example, the antenna portions 200*a* and 200*b* of each antenna device 200 are balanced and designed to radiate RF signals having the same wavelength λ within the same target RF spectrum band. In one specific example, the target RF spectrum band is the 3.5 GHz band. In another specific example, the target RF spectrum band is the 5 GHz band.

In another example, one or more of the antenna devices 200 secured in housing 102 are unbalanced and have antenna portions 200*a*, 200*b* that are each designed to radiate RF signals having different wavelength λ1, λ2 within different target RF spectrum bands BW1, BW2. In one specific example, the target RF spectrum band for antenna portion 200*a* of the unbalanced antenna device is the 3.5 GHz band and the target RF spectrum band for the other antenna portion 200*b* is the 5 GHz band.

In other example embodiments, antenna devices having different configurations than antenna devices 200 and tuned for other frequency ranges or radio access technologies (RATs) are also secured to housing 102, including for example antenna devices for 1.5 GHz, 2.4 GHz, and sub 2.6 GHz bands, GPS signals, Bluetooth signals, and other RATs.

Figure 9:
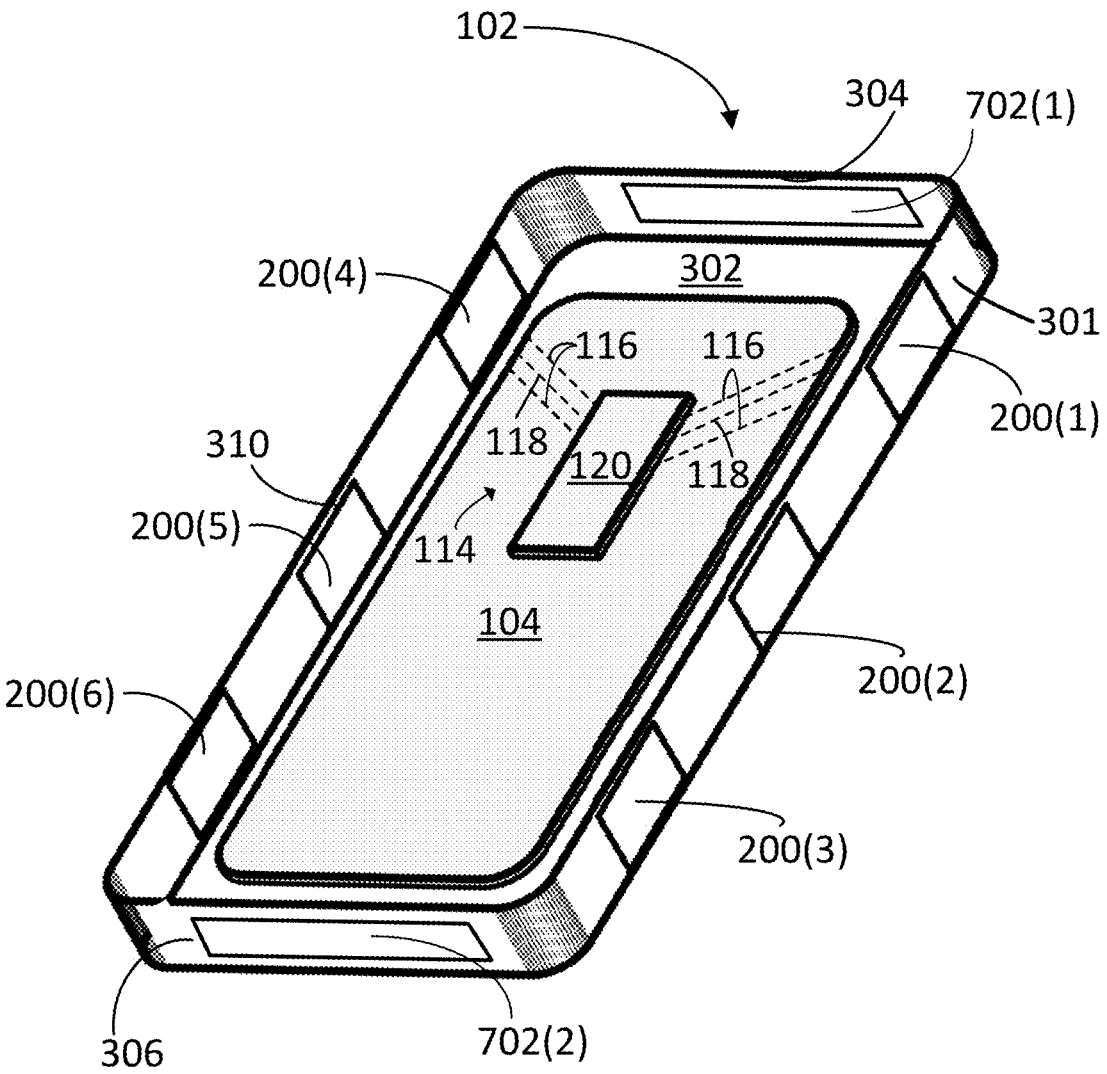
FIG. 9 is a front perspective view of a housing of a further example embodiment of the electronic device in FIG. 1, illustrating 3 antenna devices attached to each of two side rims, according to example embodiments.

In this regard, FIG. 9 illustrates an example embodiment of a housing 102 which includes a 12×12 MIMO antenna portion array of 6 antenna devices 200(1)-200(6), with each antenna portion 200*a* or 200*b* targeting either the 3.5 GHz band or 5 GHz band. The housing of FIG. 9 also includes a first sub 2.6 GHz antenna 702(1) secured to top rim portion 304 and a second sub 2.6 GHz antenna 702(2) secured to bottom rim portion 306. The antennas 702(1) and 702(2) may, in some examples, be connected to a different transceiver circuit than antenna devices 200, and may be secured to rim 301 in a different manner than antenna devices 200.

In example embodiments, the electronic device housing 102 shown in any of FIG. 5, 7 or 9 could include one or more antenna devices 280 (FIGS. 3A, 3D) or 290 (FIG. 4) in place of or in addition to antenna devices 200. In the case of antenna devices 280 and 290, antenna portions 200*a* and 200*b* may be secured to the side rim portions 308 and 310 of the housing 102 in the same manner as described above in respect of antenna devices 200. The additional antenna portions (e.g. antenna portions 240, 250, 260) may be secured to a bottom of the front enclosure element of the housing 102. Four antenna devices 280 that each function as three antennas can form a 12×12 MIMO antenna array in housing 102. Similarly, in the case of antenna devices 290 that each includes 4 antenna portions, 4 antenna devices 290 mounted in the housing 102 can form a 16×16 MIMO antenna array.

Performance of the 8×8 MIMO Antenna Portion Array

In some examples, MIMO antenna arrays such as those shown in FIGS. 5 and 7 have a low correlation between different antennas formed by antenna devices 200. For example, according to measurement results of an 8×8 MIMO antenna array formed by four antenna devices 200 such as illustrated in FIG. 2A, the Rx-Rx Envelope Correlation Coefficients are below 0.2 at 3.5 GHz. Because of the low correlation between different pairs of antennas, each of the antennas can function independently from the others, and this in turn can increase wireless channel capacity in some configurations.

MIMO antenna systems such as those illustrated in FIGS. 5 and 7 can have a high efficiency in some configurations. According to measurement results of an 8×8 MIMO antenna array formed by four antenna devices 200 such as shown in the example of FIG. 3A, the MIMO antenna array has a total radiation Rx efficiency of about 70% at resonant frequency 3.5 GHz.

The present disclosure may be embodied in other specific forms without departing from the subject matter of the claims. The described example embodiments are to be considered in all respects as being only illustrative and not restrictive. Selected features from one or more of the above-described embodiments may be combined to create alternative embodiments not explicitly described, features suitable for such combinations being understood within the scope of this disclosure.

All values and sub-ranges within disclosed ranges are also disclosed. Also, although the systems, devices and processes disclosed and shown herein may comprise a specific number of elements/components, the systems, devices and assemblies could be modified to include additional or fewer of such elements/components. For example, although any of the elements/components disclosed may be referenced as being singular, the embodiments disclosed herein could be modified to include a plurality of such elements/components. The subject matter described herein intends to cover and embrace all suitable changes in technology.

The invention claimed is:

1. A plurality of antenna devices included in a housing of an electronic device, the housing comprising a back enclosure element surrounded by a forwardly projecting rectangular rim that includes top and bottom rim portions that extend between first and second side rim portions, the plurality of antenna devices comprising a set of first antenna devices that each comprise:

a radiator that functions both as a first antenna and as a second antenna that each radiate signals within a first target frequency band;

a ground terminal directly connected to the radiator between a first end and a second end of the radiator;

a first feed terminal for the first antenna, directly connected to the radiator at a first feed point between the first end of the radiator and the ground terminal; and a second feed terminal for the second antenna, directly connected to the radiator at a second feed point between the second end of the radiator and the ground terminal, wherein the first feed terminal, the second feed terminal, and the ground terminal extend from an edge of the radiator in a common plane that is perpendicular to a plane of the radiator, the set of first antenna devices including two first antenna devices whose respective radiators are located in the first side rim portion and two first antenna devices whose respective radiators are located in the second side rim portion;

the plurality of antenna devices comprising a set of second antenna devices that each comprise:

a radiator that functions as an antenna that radiates signals within a second target frequency band, the set of second antenna devices including a second antenna device whose radiator is in the top rim portion and a further second antenna device whose radiator is in the bottom rim portion.

2. The plurality of antenna devices of claim 1 wherein, for each of the first antenna devices, the radiator is an oblong conductive element.

3. The plurality of antenna devices of claim 2 wherein, for each of the first antenna devices, the radiator is planar.

4. The plurality of antenna devices of claim 3 wherein, for each of the first antenna devices, the radiator is rectangular or approximately rectangular.

5. The plurality of antenna devices of claim 1 wherein, for each of the first antenna devices, the first antenna and second antennas are each quarter wavelength antennas.

6. The plurality of antenna devices of claim 1 wherein, for each of the first antenna devices, a distance of the first feed point from the first end of the radiator and a distance of the second feed point from the second end of the radiator is less than ¼ of a wavelength of a radio wave signal within the first target frequency band.

7. The plurality of antenna devices of claim 6 wherein, for each of the first antenna devices, the radiator has a length of L=35 mm+/−15%, the distance of the first feed point from the first end of the radiator is 14 mm+/−15%, the distance of the second feed point from the second end of the radiator is 14 mm+/−15%.

8. The plurality of antenna devices of claim 7 wherein, for each of the first antenna devices, the ground terminal is located at a mid-point between the first feed point and the second feed point.

9. The plurality of antenna devices of claim 1 wherein, for each of the first antenna devices, dimensions of the radiator and locations of the ground terminal, first feed terminal and second feed terminal configure the first antenna and the second antenna to radiate signals within the first target frequency band of between 3 GHz and 6 GHz.

10. The plurality of antenna devices of claim 9, wherein the first target frequency band is either a 3.5 GHz band or a 5 GHz band.

11. The plurality of antenna devices of claim 1, wherein, for each of the first antenna devices, dimensions of the radiator and locations of the ground terminal, first feed terminal and second feed terminal configure the first antenna and the second antenna to radiate signals within a 3.5 GHz band.

12. The plurality of antenna devices of claim 1 wherein each of the first antenna devices comprises a third antenna portion having a first end connected to the radiator thereof in electrical communication with the ground terminal thereof, and a third feed terminal connected with the third antenna portion thereof and spaced apart from the first end of the third antenna portion.

13. The plurality of antenna devices of claim 12, wherein for each of the first antenna devices, the third antenna portion includes a bend along the length between a distal end of the third antenna portion and the third feed terminal.

14. The plurality of antenna devices of claim 1, wherein the rim is formed from metal, the radiators of each of the first antenna devices being insert molded into the rim and having an outer surface forming part of an outer surface of the rim.

15. The plurality of antenna devices of claim 1, wherein the rim is formed from plastic, the radiators of each of the first antenna devices being formed on the rim using a laser direct structuring (LDS) process.

16. The plurality of antenna devices of claim 1, wherein the rim is formed from plastic, the radiators of each of the first antenna devices being integrated into a flex printed circuit board (PCB) secured to the rim.

17. The plurality of antenna devices of claim 1 wherein the set of four first antenna devices collectively form an 8×8 Multiple Input Multiple Output (MIMO) antenna array.

18. The plurality of antenna devices of claim 1 wherein the set of four first antenna devices are arranged in the housing to cause Rx-Rx Envelope Correlation Coefficients between the first antenna devices to be below 0.2 when the first target frequency is 3.5 GHz.

* * * * *